United States Patent [19]

Von Kemenczky

[11] 4,412,205

[45] Oct. 25, 1983

[54] SWITCH CONSTRUCTION RESPONSIVE TO MOTIONS OF A WEARER

[75] Inventor: Miklos Von Kemenczky, Greenville, N.J.

[73] Assignee: Guilden Development Corp., N.J.

[21] Appl. No.: 295,841

[22] Filed: Aug. 24, 1981

[51] Int. Cl.[3] ..... G08B 5/00; F21L 15/08

[52] U.S. Cl. ..... 340/331; 200/61.48; 36/137; 340/321; 362/103; 362/806; 362/808

[58] Field of Search ..... 340/331, 321, 573; 362/103, 806, 808; 36/137; 200/61.45 R, 61.52, 61.48

[56] References Cited

U.S. PATENT DOCUMENTS 2,297,095 9/1942 Bassett ..... 200/61.48

2,572,760 10/1951 Rikelman ..... 362/103

2,632,093 3/1953 Merolis et al. ..... 362/103

4,311,891 1/1982 Faust ..... 200/61.45 R

*Primary Examiner*—James J. Groody

*Attorney, Agent, or Firm*—Charles E. Temko

[57] ABSTRACT

A switch construction for use on an illuminated article worn by a user which closes a circuit providing current to an illumination source only upon the occurrence of acceleration reacting to motions of the user while at the same time limiting the amount of time the illumination source is operative, and preventing accidental continuous operation of the illumination source while the device is not in use or the body of the wearer is motionless. The switch is not gravity sensitive, and can operate in any position on the body of the wearer.

15 Claims, 3 Drawing Figures

SWITCH CONSTRUCTION RESPONSIVE TO MOTIONS OF A WEARER

BACKGROUND OF THE INVENTION

This invention relates generally to the field of novelty clothing or attachments, such as might be worn by a child at nighttime or by persons dancing, jogging or the like, and more particularly to an improved switch means therefor which provides a limited duty cycle of illumination, thereby greatly extending battery life.

The use of an illumination means on or in conjunction with a shoe or slipper is, of course, well known, as exemplified by U.S. Pat. Nos. 3,800,113 and 4,020,575. It is also known to provide means sensitive to the flexing of the shoe or slipper to illuminate a battery powered lamp, so that illumination is provided during a part of each step of a wearer, rather than continuous operation with accompanying battery drain. Unfortunately, where the closing of the switch depends upon deformation of a portion of the shoe or slipper, the switch may be closed by the occurrence of such deformation even when the shoe or slipper is not being worn. This might occur during storage, or if accidentally sat upon, or if inadvertently covered by a relatively heavy object, such as a toy, blanket or the like. Further, manufacture of such a device is inherently more critical with respect to positioning of the switch on the shoe or the slipper, the stitching of the members which coact with the switch, and the like.

Ideally in a shoe or slipper use, the lamp should become illuminated with a relatively short duty cycle, as the wearer steps forward, so as to permit long battery life. Should the wearer sit with the slipper in flexed condition, the lamp should not remain illuminated after movement of the foot ceases. In devices of this general type, the relatively small dry cell employed can be fully exhausted within half an hour of continuous use. Continuous illumination of the lamp will result in a requirement for frequent battery replacement.

SUMMARY OF THE INVENTION

Briefly stated, the invention contemplates the provision of an improved switch which can be incorporated in an illuminated slipper of known type, which is closed solely by the occurrence of an angular acceleration imparted to the shoe or slipper upon which it is installed. The closing of the switch may be so arranged as to provide for operation under the occurrence of angular acceleration in a single angular direction, although, where desired, arrangement can be made for operation on the occurrence of angular acceleration in either of two angular directions. This constuction allows independence from linear acceleration and therefore from gravitational forces as well. The angular acceleration imparted to the switch results from a complex motion imparted as the wearer walks, with a substantial angular component which is sensed by the switch. Although the disclosed embodiment shows the switch in conjunction with a shoe or slipper, the switch may be mounted on other portions of the body to sense similar angular accelerations with movement of the wearer, to have application in such devices as a warning light worn by a nighttime jogger or bicycle rider.

The switch includes a pivotally supported balanced mass which is supported for rotation about an axis perpendicular to the line of motion of the foot during normal walking, pivotal movement of the mass being utilized to move one or more flexible elongated contacts against one or more similar contacts. Each contact pivots or bends about a different axis, so that communication between the contacts may be provided during movement of the balanced mass over a predetermined area. During the closed position, the contacts exhibit a mutual relative sliding movement tending to clear the cooperating surfaces of any oxides which may have formed thereon between periods of use as is customary with switch designs of this type.

In one embodiment, one or more battery cells are used as the mass as a means for maintaining total weight as low as possible and for achieving the most compact physical dimensions. For maximum sensitivity, the active mass must be as large as possible consistent with this criterion. By using a pair of dry cells which are mounted in opposite directions to one another, balanced weight compensation is obtained because the center of gravity of the individual dry cell may not lie at the geometric center of the cell.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
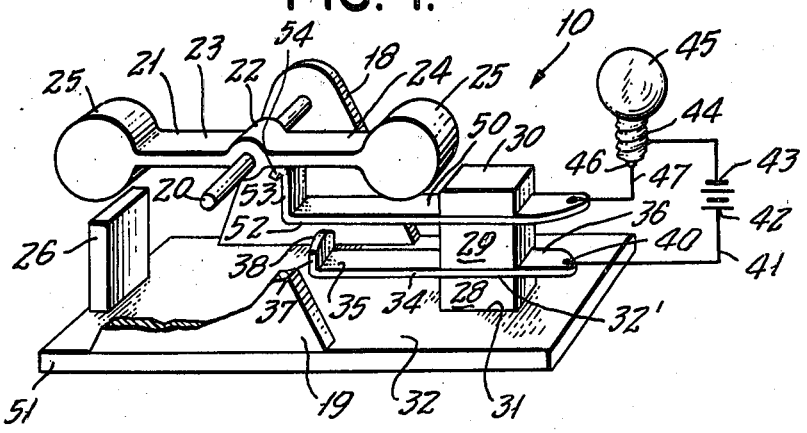
FIG. 1 is a view in perspective, partly broken away to show detail of an embodiment of the invention.

In accordance with the invention, the device, generally indicated by reference character 10, is shown in the drawing in operative position upon a slipper 11 of well known type. As is known in the art, the slipper 11 includes a vamp portion 13, to which the device 10 may be attached.

Figure 2:
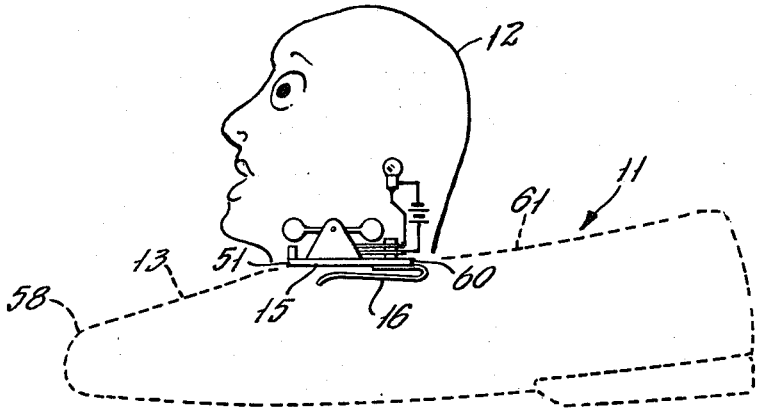
FIG. 2 is a schematic side elevational view of a slipper with the embodiment installed thereon.

Referring to FIG. 2, the device 10 includes a planar base 15, having a clip member 16 to enable removable attachment to slipper 11. Hollow translucent housing 12, shown in the form of a figurine is attached to planar base 15. The base 15 may be attached to other portions of clothing, belts, or straps intended to be worn by the user, such as on the ankle for joggers or bicyclists, on a hat, on a backpack, and the like. The base supports first and second trunnions 18 and 19 in turn supporting a transversely extending shaft 20. Medially disposed on the shaft 20 is a balanced mass 21 including a hub portion 22, a pair of radially extending webs 23 and 24 each having an enlarged terminal 25.

Beneath the forward terminal 25 is a rotation limiting stop 26. Stop 26 is employed if only one direction of angular motion is intended to operate the lamp portion of the device.

Supported upon the base 15 are first, second and third mounting blocks 28, 29 and 30. The first block 28 includes a lower surface 31 resting upon an upper surface 32 of the base. An upper surface 32' thereof supports a brass contact tongue 34 having first and second ends 35 and 36, respectively. The end 35 includes an upwardly extending terminal 37 having a rounded upper surface 38. The second end 36 is electrically connected through the soldered end 40 of a conductor 41 to a first terminal 42 of a dry cell. A second terminal 43 thereof is connected to the base 44 of a small incandescent lamp 45. The circuit is completed at the centrally disposed soldered tip 46 thereof through a conductor 47.

The second block 29 is carried by the upper surface of the tongue 34 and in turn supports a second contact tongue 50 having a first end connected to the conductor 47 and a second end 52 having an upturned terminal 53 and a headed over tip 54 underlying the under surface of the web 24. The third mounting block 30 surmounts the second block 29 and maintains the tongue 50 in position.

As seen in FIG. 2, the device 10 is installed on the slipper such that a first end 51 of the base is directed toward the front end 58 of the slipper, while a second end 60 is adjacent the foot opening 61 of the slipper. This will enable the balanced mass to react to the movement of the slipper during walking. Housing 12 contains device 10 and is illuminated when incandescent lamp 45, shown in FIG. 1, is energized.

In this orientation, it will be observed that lateral, forward and rearward linear movement of the foot during walking, or other movements will have no effect on the balanced mass whatsoever. The same is true when the foot is at rest. If the toe of the foot is tilted upward, the mass will rotate counterclockwise relative to the base 11 as seen in FIG. 2 until the forward enlargement 25 strikes the stop 26. If the toe is lowered, or the heel raised, the balanced mass will rotate clockwise relative to the base, resulting in depressing the tongue 50 until contact is made with the tongue 34, thus completing the circuit and illuminating the lamp 45. Additional acceleration caused by this movement will serve to further depress the tongue 50, and result in further movement of the tongue 34. This action will result in a scraping motion at the areas of electrical contact, tending to clean the same of accumulated oxides.

The motion required to cause illumination of the lamp will normally commence with each step, this resulting in a more or less continuous angular displacement of the slipper in a clockwise direction as seen in FIG. 1 up to the point where the wearer has pivoted about the ball of the foot, and the toe loses contact with the floor. At this point, the angular acceleration commences in the reverse direction, resulting in opening of the switch and extinguishment of the lamp. As can readily be seen, mounting additional mounting blocks similar to 28, 29 and 30 as well as contact blades similar to 34 and 50 in place of stop 26, such that the new or additional contact blades are electrically connected to blades 34 and 50, lamp 45 will illuminate on angular acceleration in two directions.

Figure 3:
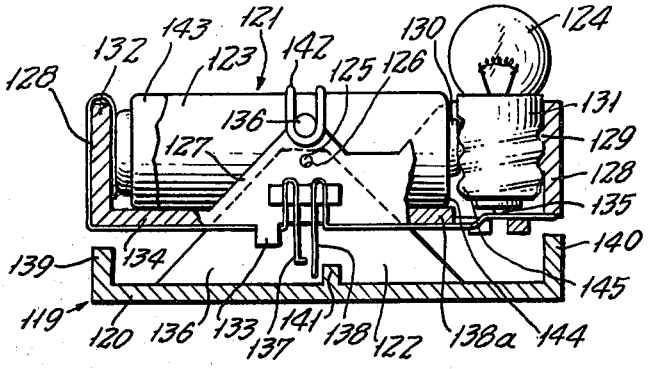
FIG. 3 is a view in elevation showing a second embodiment of the invention.

Turning now to the second embodiment of the invention, as seen in FIG. 3, there is illustrated a variation of the invention in which a battery source and an incandescent bulb form part of the balanced mass. In order to keep the overall weight of the device to a minimum for comfort in use on the body, especially by small children, a preferred embodiment is so constructed that at least fifty percent of the mass of the motor is due to the mass of the battery pair. In this embodiment, generally indicated by reference character 119, the structure includes a platform 120, or base, and a rotating element 121, both of which may be formed from molded synthetic resinous materials. Between triangularly shaped walls 122 of the platform 120, the member 121 utilizes a plurality of batteries 123 and 143, mounted one behind the other and an incandescent lamp 124. If desired, a single battey could replace batteries 123 and 143, provided, however, that the single battery (not shown) is employed when balancing member 121. Two pins 125 project from the walls 122 of the platform 120 and suspend the member 121. Corresponding holes 126 are positioned on the triangularly shaped hinges 127 of the battery case 128. A rib 129 formed inside of the case 128 secures the incandescent lamp 124 in its position. The positive pole 130 of frontmost battery 123 makes direct electrical contact with the base 131 of lamp 124. A battery clip (not shown) may be made of elastic bronze and is bent around the battery case 128, and presses the positive pole of battery 123 to contact the incandescent lamp 124 so as to establish electrical contact. Care must be taken that the diameter of lamp base 131 is of a standard size contemplated in the design of my device so that the distance from its outer edge 145 to the axis of rotation does not vary if lamps of various manufacturers are used. Battery cell 143, located behind battery cell 123, has its positive terminal connected by means well known in the art to the negative terminal of battery cell 123 (not shown). In the block 136 formed integrally with the triangularly shaped hinge 127, an L-shaped contact blade 137 and a straight contact blade 138 are positioned, preferably by ultrasonic welding. The blades 137 and 138 are also preferably formed from thin narrow strips of elastic bronze. The negative pole 144 of battery cell 143 (not shown) makes contact with a resilient battery clip (not shown) which presses the positive pole of battery 143 against a non-elastic battery clip 132.

The contact blade 137 is connected to the negative pole 144 of battery 143 by means well known in the art. The longer end 138*a* of the straight contact blade 138 is placed under the bottom tip 135 of the lamp 124 and secured in place by the surrounding structure of member 121. A small rubber ring 142 engages the ends of the pins 136 to hold the batteries 123 and 143 in place. Whereas the center of gravity of individual cylindrical batteries lies along the longitudinal axis of the cylinder, the center of gravity of batteries of some manufacturers does not lie at the midpoint of the longitudinal axis. Furthermore, the overall length of batteries of different manufacturers is not identical from one manufacturer to another. For maximum sensitivity when used with batteries of any manufacturer, the device should be constructed so that the battery case 128 is in neutral balance independently of the location of the center of gravity or overall length of the individual batteries used, as long as both batteries of the pair are identical. The battery case is constructed so that two contacts of the same polarity are in a fixed position and constructed of non-springy material and the other two contacts are constructed of springy material which presses each battery against the fixed contacts. For the sake of convenience, in the present embodiment the two positive contacts are fixed and the two negative contacts are of springy material. The position of the pole 126 is selected such that the axis of rotation lies at the midpoint of the distance between the two fixed positive contacts and also intersects the longitudinal axis of the batteries when they are in place. Battery case 128 is so weighted as to remain in neutral balance when only the batteries are removed.

The batteries are mounted with similar poles pointing in opposite directions. In this manner, even though the center of gravity of a single cell may not lie at the geometric midpoint of the cell, and even though the overall length of batteries may vary slightly from one manufacturer to another, the use of an identical pair of batteries in the device will always result in a neutrally balanced mass. The angular displacement of the member 121 is limited by stops 139 and 140 on the ends of the platform 120. The closing of a switch formed by members 137 and 138 when the member 121 is rocked in a counterclockwise direction relative to member 120 is caused by contact of a stop 141 with the end of the blade 138.

An additional set of contacts, (not shown), similar to contacts 137 and 138, operating on stop 141, for clockwise rotation would cause lamp 124 to energize in two opposite directions of angular acceleration. Housing 12, shown in FIG. 2, may be employed so as to be illuminated when lamp 124 is energized.

A third embodiment of the invention (not shown) would have the positive pole of battery 123 pressed against a non-elastic battery contact mounted in fixed position in battery case 128. The lamp 124 would be remotely mounted elsewhere on the battery case preferably close to the axis of rotation and its two terminals electrically connected by means well known in the art to blade 138*a* and the negative pole of battery 143, respectively. The embodiment would make the neutral balance of the device independent of variations in the diameter of base 131 and also would enable the use of miniature so-called "grain of wheat" type bulbs which do not have screw shell bases.

I wish it to be understood that I do not consider the invention limited to the precise details of structure shown and set forth in this specification, for obvious modifications will occur to those skilled in the art to which the invention pertains.

I claim:

1. An improved switch construction responsive to the motions of a wearer comprising: a relatively fixed base adapted to be secured to desired portions of the clothing of the wearer in relatively fixed relation thereto; a substantially balanced mass mounted for pivotal movement upon said base about an axis; means for limiting said pivotal movement of said mass in at least a first angular direction; a pair of electrical contact means, at least one of which lies in the path of pivotal movement of said mass in at least one angular direction; and a source of electromotive force and an illumination means connected in series with said contact means; whereby said contact means will be closed to illuminate said illumination means only upon the occurrence of angular acceleration of said balanced mass in said at least one angular direction.

2. An improved switch construction responsive to the motions of a wearer in accordance with claim 1, further characterized in said base including a pair of aligned trunnions extending upwardly from said base, a shaft carried by said trunnions, said balanced mass being of generally elongate configuration and having a substantially centrally disposed hub engaging said shaft, a pair of oppositely disposed web portions extending radially from said hub, and a pair of enlargements carried by the outer ends of said webs.

3. An improved switch construction responsive to the motions of a wearer in accordance with claim 2, further characterized in said switch contacts comprising elongated conductive tongues, a free end of one of which is positioned to contact one of said radially extending webs adjacent said hub upon the rotation of said balanced mass to be displaced thereby to cause said one of said contacts to make communication with the other of said contacts, continued displacement thereafter resulting in a sliding mutual contact between said switch contacts to effect a clearing action serving to remove accumulated oxides at points of communication.

4. The improvement in accordance with claim 1, in which said source of electromotive force forms part of said balanced mass.

5. The improvement in accordance with claim 1, in which said source of electromotive force forms at least fifty percent of the mass of the balanced mass.

6. The improvement in accordance with claim 1, further characterized in said illumination means forming a part of said balanced mass.

7. An improved switch construction responsive to the motions of a wearer in accordance with claim 1, further comprising means for limiting said pivotal movement of said mass in a direction opposite to said at least one angular direction.

8. An improved electrical switch construction responsive to the motions of a wearer, sensitive only to imparted rotational acceleration comprising: a relatively fixed base adapted to be secured to a moving article, a substantially balanced mass mounted for pivotal movement upon said base, at least one pair of electrical contact means, one of said contact means being disposed in the path of pivotal movement of said mass when displaced in at least one angular direction; and a source of electromotive force and an illumination means coupled to said contact means, said source of electromotive force forming at least part of said balanced mass.

9. An improved switch construction responsive to the motions of a wearer in accordance with claim 8, further characterized in said illumination means forming part of said balanced mass.

10. An improved switch construction responsive to the motions of a wearer in accordance with claim 8, further characterized in said source of electromotive force comprising a pair of elongated dry cells arranged in oppositely extending directions, so that any variation in the position of the center of gravity along the longitudinal axis of individual cells of different manufacture is compensated using an identical pair of cells.

11. An improved switch construction responsive to the motions of a wearer in accordance with claim 10, in which one pair of battery contacts of the same polarity is fixed in position and made of rigid material, and the other pair of contacts is made of resilient material so that identical cells from different manufacturers with slightly different overall lengths may be used.

12. An improved switch construction responsive to the motions of a wearer in accordance with claim 10, wherein said pair of elongated dry cells are disposed in a side-by-side relationship.

13. An improved switch construction responsive to the motions of a wearer in accordance with claims 1 or 8, further comprising means to removably secure said base to an article of clothing.

14. An improved switch construction responsive to the motions of a wearer in accordance with claims 1 or 8, further comprising a housing, said housing being secured to said base.

15. An improved switch construction responsive to the motions of a wearer in accordance with claim 14, wherein said housing is translucent.

* * * * *